US005264599A

United States Patent [19]

Hammond et al.

[11] Patent Number: 5,264,599

[45] Date of Patent: Nov. 23, 1993

[54] PROCESS FOR REDUCING CHOLESTEROL IN ANIMAL FATS

[75] Inventors: Earl G. Hammond, Ames, Iowa; Ying Chen, Madison, Wis.

[73] Assignee: Iowa State University Research Foundation, Ames, Iowa

[21] Appl. No.: 790,228

[22] Filed: Nov. 8, 1991

[51] Int. Cl.[5] ..... C11B 7/00

[52] U.S. Cl. ..... 554/204; 554/207; 552/542; 552/544; 552/545

[58] Field of Search ..... 260/413.5, 424, 420; 552/542, 480, 545, 544; 424/2; 554/204, 207

[56] References Cited

U.S. PATENT DOCUMENTS 5,045,242 3/1991 Rocyniak et al. ..... 260/424

OTHER PUBLICATIONS

Klein, B. et al., Clinical Chemistry, vol. 20, #4, pp. 482–485, 1974.

*Primary Examiner*—José G. Dees
*Assistant Examiner*—Deborah D. Carr
*Attorney, Agent, or Firm*—Tilton, Fallon, Lungmus & Chestnut

[57] ABSTRACT

A process is provided for treating an edible animal fat to reduce the content of components having free hydroxyl groups. The process comprises forming a reaction mixture from the fat and a cyclic anhydride such as succinic or glutaric anhydride, heating the mixture to a temperature promoting conversion of these components to hemisuccinates or hemiglutarates, and subjecting the reacted fat to alkali-refining to remove the converted components as water-soluble soaps. The process is particularly useful for reducing the cholesterol content of the animal fats.

8 Claims, 1 Drawing Sheet

PROCESS FOR REDUCING CHOLESTEROL IN ANIMAL FATS

FIELD OF INVENTION

The field of this invention is the treatment of animal fats, and, more particularly, the treatment of animal fats to reduce the amount of cholesterol therein.

BACKGROUND OF THE INVENTION

Because animal fats tend to be saturated and contain cholesterol, many American consumers minimize consumption of animal fats, and the price of such fats has declined relative to vegetable oils. At present, there is little prospect of processing technology which will increase the unsaturation of animal fats. Moreover, dietary manipulation of the composition of animal fat by alteration of the animal's diet has not been found practical. Although there is still considerable demand for solid fats in shortenings and spreads, animal fats are not able to compete effectively with vegetable oils because of their content of cholesterol. As a result, a number of schemes have been proposed to remove the cholesterol from animal fats. These methods have included fermentation with cholesterol-degrading bacteria, molecular distillation, deodorization, solvent extraction, extraction with supercritical carbon dioxide, and enzymatic alteration. However, none of these methods has gained widespread acceptance. Most proposed methods do not appear economically feasible.

SUMMARY OF INVENTION

Animal fats are composed of mixtures of long chain fatty acids. When produced from domestic animal sources such as cattle, sheep, and swine, the fats contain cholesterol which it is desired to remove, as well as other compounds having free hydroxyl groups, which it may also be desirable to remove.

It is known that succinic anhydride can be reacted with cholesterol in an organic solvent such as pyridine or xylene to produce cholesteryl hemisuccinate. (See, for example, Drasar et al., 1983, *Collect. Czech. Chem. Commun.*, 49:307–313; and Klein et al, *Clin. Chem.*, 1974, 20:482–485).

As far as it is known, cyclic anhydrides such as succinic or glutaric anhydride have not previously been reacted with animal fats for any purpose. However, acetic anhydride is used as a reagent for determining hydroxyl and acetyl values in animals fats (A.O.C.S. Official Methods Cd 4–40 and Cd 13–60), Animals fats in liquid condition are essentially nonpolar. Succinic and glutaric anhydrides have very limited solubility in liquified animal fats even when the fats are heated to temperatures in excess of 100° C. Moreover, in the course of experimental work leading to the present invention, it was found that such cyclic anhydrides when mixed with heated animal fats tend to sublime and be lost from the reaction mixture. However, it was discovered that by incorporating minor amounts of acetic or propionic acid in the heated animal fats that the reaction of the anhydrides with the cholesterol therein or with other hydroxyl-containing components can be promoted. The acetic or propionic acid also functions as a refluxing agent to prevent evolution and loss of the anhydride reagent from the reaction mixture.

The process of this invention therefore provides a means for reducing cholesterol in animal fats. Although the cholesterol is present at low concentrations, it can be reacted with succinic or glutaric anhydrides to produce a hemisuccinate or hemiglutarate derivative. It has also been found that these cholesterol derivatives can be removed from the fat by an alkali refining treatment. By combining the described sequence of treatments, a process is provided which can effectively reduce the cholesterol content of animal fats. The process can also be used to reduce the content of other components of the fats having free hydroxyl groups.

THE DRAWING

FIG. 1 is a diagramatic representation of the reaction scheme which forms the basis of the first step of the process of this invention. As illustrated, succinic anhydride reacts with cholesterol through its free hydroxyl group to produce cholesteryl hemisuccinate. The compound has a free carboxylic acid group that can be reacted in aqueous alkali to form a soap, which is soluble in the aqueous alkali solutions.

DETAILED DESCRIPTION

Figure 1:
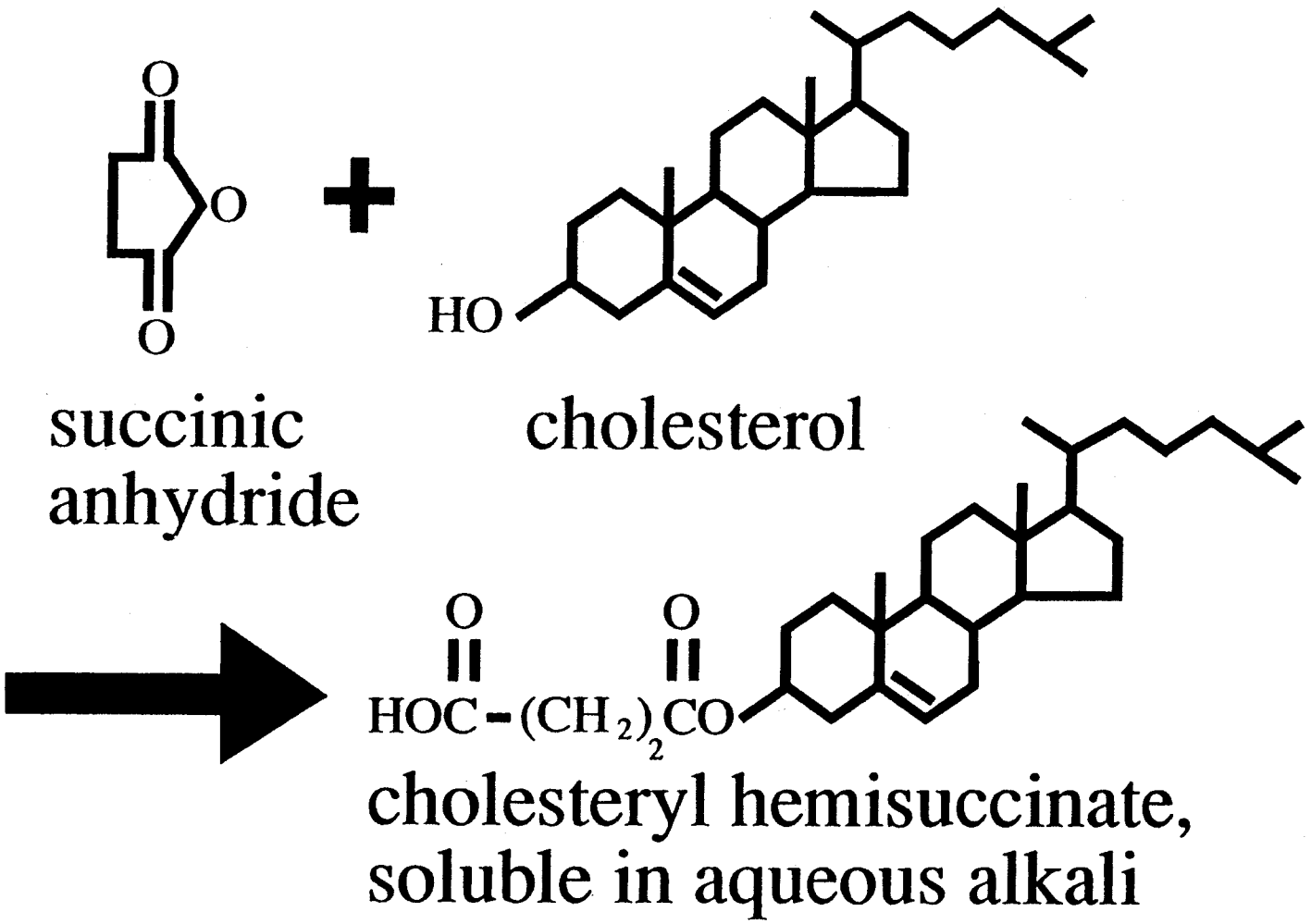

The term "animal fat" as used herein refers to the edible fats derived from domestic mammals, including particularly cattle, sheep, and swine. The term "animal fat" therefore includes lard, lard oil, tallow, tallow oil, and butter fat. All of these animal fats contain cholesterol. The amounts of cholesterol present vary with the particular animal but, in general, ranging from 0.05 to 0.5 weight percent. The process can also advantageously be applied to animal fats which have been enriched with cholesterol, such as by-product fractions obtained by supercritical extraction of butterfat. Although the amount of cholesterol usually present in natural fats is a small percentage of the fat, it is desirable to reduce the amount of cholesterol as much as possible. Such animal fats also contain other minor components having free hydroxyl groups, which it may be desirable to remove. For example, milk fats contain fatty acids having free hydroxyl groups, which may result in the development of characteristic flavors when the milk fat is heated.

For practicing the process of the present invention, the edible animal fats, containing cholesterol and/or other components having free hydroxyl groups are subjected to reactive treatment with a cyclic anhydride. The animal fat is preferably substantially free of water, viz., below 0.1% water. The preferred cyclic anhydrides are succinic anhydride or glutaric anhydride. Because of its lower cost, it is believed that succinic anhydride will be the reagent of choice for commercial purposes.

The primary reagent for the first step of the process is a cyclic anhydride which is reactable with cholesterol to form a compound having a free carboxylic acid group. As indicated above, the preferred cyclic anhydride is succinic or glutaric anhydride. The cyclic anhydride is preferably used in a molar excess with reference to the components of the fat, such as cholesterol which have free hydroxyl groups. Since cholesterol is the primary such component, the cyclic anhydride can be introduced in an amount which is at least equal on a molar basis to the content of cholesterol and other hydroxyl-containing compounds in the fat. Preferably at least a 10 to 20% molar excess with reference to cholesterol is used. To assure greater completeness of reaction, larger molar excesses of the cyclic anhydride can be employed. It does not appear that there is usually an advantage to using more than 4 moles of the anhydride per mole of cholesterol. However, more anhydride can be used if side reactions consume part of this reagent. On a cholesterol to anhydride basis, therefore, the molar proportions may range from 1:1.2 to 1:4. An optimum molar ratio on the same basis is estimated to be in the range from about 1:2 to 1:3.

In accordance with a general method of this invention, the cyclic anhydride reagent in the form of a powder can be mixed directly with the heated animal fat and reacted therewith. However, the anhydride dissolves slowly and therefore relatively long reaction times may be required. Also, some loss of the cyclic anhydride can occur due to sublimation from the reaction mixture. In preferred embodiments, a short chain fatty acid is employed as a reaction promoter. The preferred promoters are acetic or propionic acids, which can be used in amounts from 0.02 to 0.15 parts by weight per part of the fat. Other short chain fatty acids can be used, but there does not appear to be any advantage in doing so. Larger amounts of these acids can be used. As the quantities are increased there is a tendency for the acid to react with components of the fats, but it is desired to have the acid present essentially as a non-reacting "catalyst". In preferred embodiments, therefore, the amounts of acetic or propionic acids can range from 2 to 5 parts by weight per 100 parts of the fat. More broadly, from as little as 0.5 up to 15 parts by weight of the catalyst acid can be used per 100 parts of fat while still obtaining the desired catalyst/reflux effects.

The cyclic anhydride and the short chain fatty acid can be added separately to the heated fat and mixed therewith, or the cyclic anhydride can first be dissolved in the short chain fatty acid, and this premix added to the fat.

After the reaction mixture has been formed, it is heated at a temperature promoting conversion of the cholesterol or other hydroxyl-providing components to hemisuccinates or hemiglutarates. For example, the heating may be carried out at temperatures of 120° to 140° C. In order to prevent loss of the anhydride reactant by sublimation, it is desirable to carry out the reaction under reflux conditions. Use of reflux conditions is facilitated when the reaction mixture contains acetic or propionic acid, as described above. These acids will reflux and assist in maintaining the cyclic anhydride in the reaction mixture. Adequate reflux is provided for this purpose when the reaction mixture contains 5 to 15 parts of acetic or propionic acid per 100 parts of fat. When it is desired to employ lesser amounts of the acid, the reaction may be carried out in a sealed container that is placed in a liquid with a suitable boiling point, such as xylene. Carrying out the reaction in a sealed container also has the advantage of limiting the oxidation of the fat. The container can be evacuated. Alternatively, the sealed container can be used with an inert atmosphere, such as a nitrogen atmosphere.

It is desirable but not essential to stir the reaction mixture while it is being heated. Under conditions of mild agitation and at the temperatures described, several hours of heating are desirable to assure completion of the reaction. For example, the reaction mixture may be heated for 3 to 12 hours.

After the conversion of the cholesterol (or other hydroxyl-providing components) has been completed, and the hemisuccinates or hemiglutarates have been formed, the reaction mixture is cooled, for example, to room temperature (20°-25° C.). The treated fat may then be subjected to alkali refining. The admixture of the fat and hemisuccinate derivatives will comprise an oil phase. By admixing under conditions of agitation with a dilute solution of an aqueous alkali, the hemisuccinates can be reacted with an alkaline substance to form water-soluble soaps. The soaps are transferred to the aqueous water-phase, and can be separated from the reaction mixture. For example centrifugal phase contacting and phase separation can be employed.

For purpose of the present invention, strong alkalis such as sodium hydroxide, appear to be less desirable than milder alkalis such as sodium carbonate, bicarbonate, or phosphate. Such salts provide a milder alkaline pH, such as a pH in the range of 8 to 12. Sodium carbonate has been found to be a particularly desirable alkaline reagent for the alkali refining treatment. Sodium carbonate or other comparable alkaline reagent can be employed in aqueous solution at concentrations of from about 1 to 21 weight percent. For example, a 5% aqueous solution of sodium carbonate provides good results.

The process of the present invention removes free cholesterol. If the cholesterol is present in esterfied form, it will not be removed. Furthermore, since cholesterol may form other derivatives bedsides the hemisuccinates, the present invention does not necessarily remove all of the free cholesterol, but substantial reductions in cholesterol content can be obtained. For example, reductions in the range of 40 to 42% have been obtained with respect to lard, lard oil, tallow and tallow oil. A somewhat lesser reduction in cholesterol content has been obtained with respect to butter oil, for example, around a 30% reduction. It is preferred to react at least 25% on a molar basis of the hydroxyl-providing components.

EXAMPLE

In an illustrative embodiment, succinic or glutaric anhydride is reacted with the animal fat in the presence of acetic or propionic acid. The anhydride is used in the amount of 0.9 parts by weight per 100 parts of the animal fat together with 5 parts of the promoter acid (acetic or propionic) per 100 parts of the animal fat. Preferably, the anhydride is premixed and dissolved in the acid promoter, and that mixture is then combined with the animal fat. The reaction mixture is heated under reflux conditions at a temperature of around 133° C. The heating of the reaction mixture with gentle stirring is continued for 7 to 8 hours.

After completion of the reaction, the cholesteryl hemisuccinate is extracted with a 5% by weight aqueous solution of sodium carbonate. The solution is mixed thoroughly with the reacted animal fat, using 0.5 to 1 parts by volume of the sodium carbonate solution per part by volume of the animal fat. During this treatment, the temperature is kept high enough so that the animal fat is in liquid condition. The mixture is then centrifuged at sufficient speed to separate the aqueous phase, which will contain the extracted soap of cholesterol hemisuccinate. The cholesterol content of the fat can thereby be reduced from 40 to 45% or greater.

The reaction procedure of the foregoing examples can be used for other cholesterol-containing fats besides lard. For example, the process can be applied in the same way to butter fat or tallow. If available at a reasonable cost, glutaric anhydride can be substituted on an equal molar basis for the succinic anhydride. The alkali refining procedure and subsequent processing of the oil can also be varied while still achieving the results of this invention.

We claim:

1. A process for treating an edible animal fat to reduce the content of components having free hydroxyl groups, comprising:

(a) forming a reaction mixture from the fat and a cyclic anhydride selected from the group consisting of succinic and glutaric anhydrides, said anhydride being present in molar excess over said hydroxyl-containing components;

(b) heating said mixture at a temperature promoting the conversion of said components to hemisuccinates or hemiglutarates; and (c) subjecting the resulting reacted fat to alkaline refining to remove the converted components as water-soluble soaps.

2. The process of claim 1 in which said animal fat contains free cholesterol and said process is carried out primarily to reduce the cholesterol content of the fat.

3. The process of claims 1 or 2 in which said heating is at a temperature of from about 130° to 140° C., and is continued until at least 25% of the said free hydroxyl-containing components are converted to hemisuccinates or hemiglutarates.

4. The process of claim 1 in which said reaction mixture contains from 0.5 up to 15 parts by weight of acetic acid or propionic acid per 100 parts of fat.

5. The process of claim 5 in which said reaction is carried under reflux conditions with a sufficient amount of the acetic or propionic acid being present to provide the reflux.

6. The process for treating an edible animal fat to reduce the content of free cholesterol, comprising:

(a) forming a reaction mixture from the cholesterol-containing fat and succinic anhydride, said anhydride being present in at least 1.2 molar excess over the free cholesterol in the fat;

(b) heating said mixture at a temperature promoting the conversion of the cholesterol in the fat to cholesteryl hemisuccinate; and (c) subjecting the reacted fat to alkaline refining to remove the cholesteryl hemisuccinate as a water-soluble soap.

7. The process of claim 6 in which said reaction mixture also contains an acid selected from the group consisting of acetic acid and propionic acid, the amount of said acid present being from 0.5 to 15 parts by weight per 100 parts of fat.

8. The process of claim 7 in which said reaction is carried out under reflux conditions and a sufficient amount of said acid is present to provide said reflux.

* * * * *